United States Patent [19]

Chang

[11] Patent Number: 4,812,708

[45] Date of Patent: Mar. 14, 1989

[54] THIN CATHODE-RAY TUBE

[75] Inventor: Kern K. N. Chang, Princeton, N.J.

[73] Assignee: RCA Licensing Corp., Princeton, N.J.

[21] Appl. No.: 695,885

[22] Filed: Jan. 29, 1985

[51] Int. Cl.[4] ..... H01J 29/00

[52] U.S. Cl. ..... 313/477 R; 220/2.1 A; 313/422

[58] Field of Search ..... 313/422, 477 R, 407; 220/2.1 A, 2.3 A

[56] References Cited

U.S. PATENT DOCUMENTS

| | | | |
|---|---|---|---|
| 3,185,879 | 5/1965 | Evans | 313/422 |
| 3,205,391 | 9/1965 | Glyptis | 313/422 |
| 3,621,319 | 11/1971 | Heynisch et al. | 313/422 |
| 3,643,122 | 2/1972 | Bossers | 313/477 R |
| 3,806,750 | 4/1974 | Tsuneta et al. | 313/64 |
| 4,075,535 | 2/1978 | Geneguand et al. | 313/422 |
| 4,117,368 | 9/1978 | Marlowe et al. | 313/422 |
| 4,118,651 | 10/1978 | Scott | 313/422 |
| 4,180,760 | 12/1979 | Chang | 313/422 |
| 4,310,779 | 1/1982 | Penird et al. | 313/407 |
| 4,374,343 | 2/1983 | Chang | 313/422 |
| 4,429,254 | 1/1984 | Chang | 315/3 |

FOREIGN PATENT DOCUMENTS

| | | | |
|---|---|---|---|
| 0066155 | 6/1978 | Japan | 313/477 R |

*Primary Examiner*—David K. Moore
*Assistant Examiner*—Mark R. Powell
*Attorney, Agent, or Firm*—E. M. Whitacre; D. H. Irlbeck; T. H. Magee

[57] ABSTRACT

A thin cathode-ray tube includes a back section having a surface boundary substantially symmetrical in shape to that of a faceplate panel sealed thereto, the back section suppporting a mount which includes an electron gun disposed within the symmetrical boundary.

7 Claims, 1 Drawing Sheet

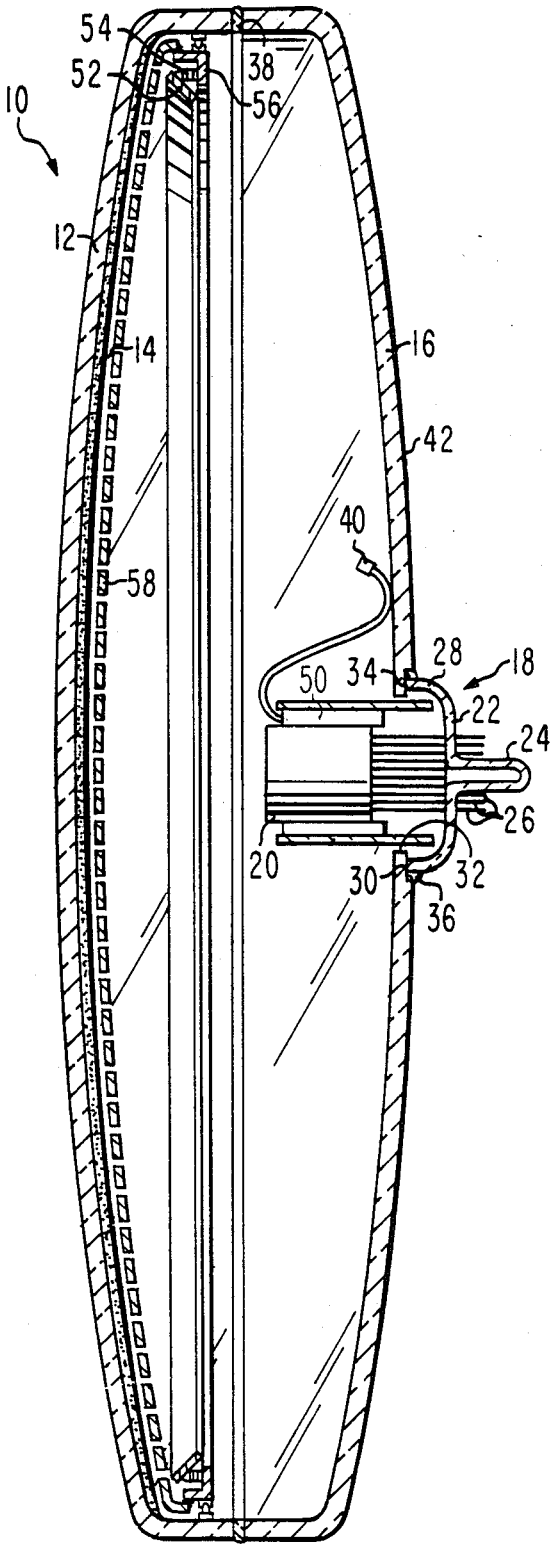
54
52
38
56
10
12
14
16
42
40
58
28
18
50
34
22
24
26
20
30
32
36

THIN CATHODE-RAY TUBE

BACKGROUND OF THE INVENTION

This invention pertains to a thin cathode-ray tube.

A standard cathode-ray tube comprises a faceplate panel with a cathodoluminescent screen, a funnel-shaped back section having a neck, and a mount containing an electron gun. The back section typically is sealed to the faceplate panel in a high-temperature oven using a glass frit before the mount is sealed to the neck of the funnel-shaped back section. The mount is sealed to the neck of the back section by a flame-sealing apparatus which necessarily requires the protruding-shaped neck in order to effectively apply a localized torch of the flame-sealing apparatus.

Efforts to decrease the overall depth of such tubes have resulted in cathode-ray tubes designed so that the protruding-shaped neck is geometrically repositioned from the center of the funnel-shaped back section to a side-mounted location whereat the electron gun emits electrons having an initial direction of travel substantially parallel to the cathodoluminescent screen. An example of such a tube is described in U.S. Pat. No. 4,374,343 issued to me on Feb. 15, 1983, and assigned to RCA Corporation. However, it is difficult to effectively deflect the electron beam from such a side-mounted gun so that it scans the entire screen while simultaneously focusing the beam and bending it toward the screen.

In order to improve the focusing capability of the electron beam while simultaneously achieving a thinner cathode-ray tube, it is desirable to position the mount containing the electron gun closer to the screen while keeping the gun pointed in a direction orthogonal to the center of the screen. The geometrical considerations for the design of such a tube require a differently shaped back section which may not include a neck, thereby precluding the feasibility of utilizing a mount-sealing step wherein a torch is applied to the neck. The present invention achieves a thinner cathode-ray tube, having a substantially symmetrical design, wherein the mount of the tube is frit sealed to the back section thereof.

SUMMARY OF THE INVENTION

The present invention comprises a thin cathode-ray tube wherein a back section thereof has a surface boundary substantially symmetrical in shape to that of a faceplate panel sealed thereto, the back section supporting a mount which includes an electron gun disposed within the symmetrical boundary.

BRIEF DESCRIPTION OF THE DRAWING

The drawing is a diagrammatic cross-sectional view illustrating a thin cathode-ray tube.

DETAILED DESCRIPTION OF THE PREFERRED EMBODIMENT

The drawing shows a thin cathode-ray tube 10 comprising a faceplate panel 12 having a cathodoluminescent screen 14 located on an inner surface thereof and a back section 16 peripherally attached thereto. The back section 16 supports a mount 18 including an electron gun 20 which is pointed in a direction othogonal to the center of the screen 14. The mount 18 comprises a glass dome 22 which has a tubulation 24 for exhausting the tube 10, and also has wire leads 26 extending therethrough which support the electron gun 20 and provide electrical connection thereto. The glass dome 22 has a base 28 which is frit sealed to an edge 30 of an aperture 32 disposed in the back section 16. Preferably, the base 28 of the dome 22 is supported by and sealed to a recessed ledge 34 disposed around the edge 30 of the aperture 32 using a glass frit 36. A glass frit 38 is also disposed between the back section 16 of the cathode-ray tube 10 and the faceplate panel 12. The mount also includes a frittable getter 40 capable of withstanding a high temperature- heating step.

The back section 16 of the thin cathode-ray tube 10 has a surface boundary 42 which is substantially symmetrical in shape to that of the faceplate panel 12. The surface boundary 42 is defined as the outer or exposed surface area of the back section 16. The surface boundary 42 does not have to be exactly symmetrical to that of the faceplate panel 12 but only similar in overall shape, meaning that the faceplate of the panel 12 may be flat while the boundary 42 is slightly spherical. Preferably, the back section 16 comprises a panel which is substantially identical to the faceplate panel 12. The back section 16 of the tube 10 may comprise a panel which has been rejected for use as a faceplate panel due to poor optical characteristics.

In order to make the cathode-ray tube 10 as thin as possible, the mount 18 containing the electron gun 20 is positioned closer to the cathodoluminescent screen 14 than the gun-to-screen spacing in standard prior-art tubes. In order to accomplish this, the electron gun 20 is disposed within the symmetrical boundary 42, so that it does not protrude therefrom similar in manner to the necks of standard prior-art tubes. The mount 18 of the thin cathode-ray tube 10 is frit sealed to the back section 16 thereof by a method described in my commonly owned application entitled "METHOD OF SEALING A MOUNT IN A CATHODE-RAY TUBE", filed concurrently herewith and having Ser. No. 696,158, now U.S. Pat. No. 4,622,084.

Due to the fact that the present novel cathode-ray tube 10 is thinner than prior-art tubes, beams of electrons emitted from the electron gun 20 must be deflected at an angle greater than the typical standard prior-art deflection angle of 110°. In the present embodiment, an internal yoke 50 is utilized to deflect the electron beams to provide a total deflection angle of up to 150°. For example, an internal deflection yoke integrated within a tube is described in U.S. Pat. No. 4,429,254 issued to me on Jan. 31, 1984 and assigned to RCA Corporation, which is incorporated herein by reference. However, a larger deflection angle creates a problem of poor image size at the perimeter of the screen 14. Due to the greater angle of incidence, the spot size luminesced by the electron beams, as they strike the perimeter area of the screen 14, is too large for good resolution.

In order to improve the focus of spots luminesced by electron beams at large deflection angles, conductive focusing means is disposed around the perimeter of the cathololuminescent screen 14 for locally altering the trajectory of the beams adjacent the perimeter. The conductive focusing means may comprise a metallic loop 52 which is attached, via four insulator posts 54, to a shadow-mask frame 56 used for supporting an apertured shadow mask 58 adjacent the screen 14. The conductive loop 52 is operated at a potential below the ultor voltage in order to create a retarding field which provides a more favorable landing angle for the electron beams on the screen 14, thereby reducing spot size adjacent the perimeter and achieving a focusing effect. Such a loop is described in my commonly owned application entitled "CATHODE-RAY TUBE WITH LOCALIZED FOCUSING", filed concurrently herewith and having Ser. No. 695,884; abandoned. Although the present embodiment has been described with respect to a tube having a shadow mask therein, it should be understood that the present invention also is applicable to other types of tubes, such as monochrome and penetration phosphor tubes which do not utilize shadow masks.

The present novel cathode-ray tube design has several significant advantages. In particular, the cathode-ray tube enclosure may be made of two symmetrical and identical panels. Thus, only one glass mold is needed, and those panels rejected for use as faceplate panels may now be used as back sections. The concept of utilizing back-to-back panels not only provides for a geometrically thinner cathode-ray tube, but also a tube which is structurally more stable and ultimately safer due to the elimination of the funnel-shaped back section with neck that is more prone to breaking as a result of its inherent geometrical design.

What is claimed is:

1. In a cathode-ray tube having a faceplate panel sealed to a back section thereof, said back section supporting a mount including an electron gun adapted to emit a beam of electrons for striking a cathodoluminescent screen disposed on said panel, the improvement comprising said back section having a surface boundary substantially symmetrical in shape to that of said faceplate panel, said electron gun being disposed within that portion of said surface boundary which is symmetrical to said faceplate panel.

2. A cathode-ray tube as defined in claim 1 wherein said back section comprises a panel substantially identical to said faceplate panel.

3. A cathode-ray tube as defined in claim 1 wherein said electron gun is pointed in a direction substantially orthogonal to the center of said cathodoluminescent screen.

4. A cathode-ray tube as defined in claim 3 wherein said back section has an aperture therein, and wherein said mount is frit sealed to an edge of said aperture.

5. A cathode-ray tube as defined in claim 4 wherein said mount includes a glass dome having a tubulation and wire leads passing therethrough, and wherein a base of said dome is supported by and sealed to a recessed ledge disposed around the edge of said aperture.

6. A cathode-ray tube as defined in claim 1 further comprising-conductive focusing means disposed around the perimeter of said screen and insulated therefrom for locally altering the trajectory of said electron beam adjacent said perimeter.

7. A cathode-ray tube as defined in claim 6 wherein said conductive focusing means comprises a metallic loop attached to insulating posts supported by a shadow-mask frame connected to said faceplate panel.

* * * * *